US005947324A

United States Patent [19]

Palinchak

[11] Patent Number: 5,947,324

[45] Date of Patent: Sep. 7, 1999

[54] BOTTLE-LIKE ADAPTER FOR A BEVERAGE CAN

[75] Inventor: Stephen Larry Palinchak, Naples, Fla.

[73] Assignee: Primo Products, Inc., Naples, Fla.

[21] Appl. No.: 09/118,057

[22] Filed: Jul. 17, 1998

[51] Int. Cl.[6] ..... B65D 25/20

[52] U.S. Cl. ..... 220/713; 220/711; 220/717

[58] Field of Search ..... 220/703, 711, 220/716, 717, 718, 916, 737, 713

[56] References Cited

U.S. PATENT DOCUMENTS

| | | | |
|---|---|---|---|
| 2,075,721 | 3/1937 | Hommel | 220/717 |
| 4,579,257 | 4/1986 | Brandlein | 220/717 |
| 4,883,192 | 11/1989 | Krugman | 220/711 |
| 5,000,338 | 3/1991 | Wolman | 220/718 |
| 5,071,042 | 12/1991 | Esposito | 220/711 |
| 5,176,278 | 1/1993 | Quarberg | 220/711 |
| 5,467,888 | 11/1995 | Brandstrom et al. | 220/717 |
| 5,732,851 | 3/1998 | Griffin et al. | 220/906 |

*Primary Examiner*—Stephen Castellano
*Attorney, Agent, or Firm*—Dennis G. LaPointe; Mason & Associates PA

[57] ABSTRACT

The invention is concerned with an adapter in the shape of a bottle top which will provide a bottle-like spout which is releasably attached to an aluminum beverage can so that a consumer may drink from the can as if drinking from a bottle. The adapter is so designed that it may be releasably attached to differently sized rims of differently sized cans. This is accomplished by providing two differently sized recesses in the base of the adapter. The recesses are concentric to each other but spaced from each other in the longitudinal direction of the adapter. Each of the recesses has an inclined wall that is inclined outwardly relative to an axial line through the adapter. This inclination results in a lateral ceiling which is normal to the axial line through the adapter against which the top of rim of the can will seat.

7 Claims, 3 Drawing Sheets

BOTTLE-LIKE ADAPTER FOR A BEVERAGE CAN

BACKGROUND OF THE INVENTION

This invention, generally, relates to a device that is releasably securable to variously sized metal cans to increase the palatability of drinking therefrom. More particularly, it relates to a device that provides a bottle-like spout for a beverage can.

Many beverages such as soft drinks and beer are sold in small aluminum cans. The most common can has an imperforate metallic lid or cover and has means for punching a pour opening therein so that the beverage contained within the can may be consumed.

There are a well known drawbacks associated with most all common beverage cans. The cans often sit for long periods of time in warehouses waiting for distribution to stores, for example, and warehouses are known not to be clean as far dust or other contaminants are concerned. As a result, most consumers quickly wipe off the lids of such cans before opening them and drinking therefrom in a very casual manner, at best, in a casual effort to remove germs or other contaminations.

Obviously, such casual wiping cleans off only the more visible dirt and has no effect on microscopic viruses or bacteria that may be alive and multiplying on the can top.

Quite a few inventors have tackled the problem, and numerous solutions to the problem have therefore appeared.

Of particular interest is U.S. Pat. No. 5,071,042 to Esposito and other patents cited therein. The above cited patent discloses two embodiments and how the bottle-like adapter is releasably attached to the rim of a beverage can. The first embodiment has a flexible base which has radially and inwardly extending lugs which circumferentially and at spaced locations will grip under the rim of the can to hold it in place. This embodiment further includes a concave plate having a central, oval-shaped opening and is fixedly secured about its periphery to inner side walls of the adapter.

This particular embodiment is rather complicated to produce which considerably adds to the cost of producing the same.

In a second embodiment, the adapter is secured to the rim of the can by way of a concentric groove in the flexible base of the adapter which will sandwich the rim between annular retaining rings. The retainer rings may be of a longitudinal extent so as to seal the same against the top cover of the can itself.

The above identified patent is assigned to and thereby owned by Primo Products, Inc. of 6062 Taylor Rd. in Naples, Fla. 34109. The inventor of the invention of the application at hand works under the auspices of the above identified Co. and will assign the present invention to the same Co.

One disadvantage of both embodiments of the bottle-shaped adapter is that the adapters will fit only one size can. It is well known that soft drink cans have a smaller diameter top of and therefore a smaller diameter size rim when compared to beer cans which in all major brand deliveries have a larger diameter top and therefore a larger rim. Therefore, the adapters of the above mentioned patent cannot be used interchangably on both differently sized cans.

OBJECTS OF THE INVENTION

There is a need for a device that protects consumers from having to place their mouths on beverage can tops. Such a device should be very simple to produce and therefore have a low cost. The device should also be versatile in that it is designed to fit differently sized can tops. The bottle-shaped adapter of the invention at hand accomplishes all of the above objects by designing the adapter in such a manner that there are two concentric recesses in the bottom flexible base of the adapter. The two concentric recesses have different diameters from each other. Of course, an additional recess could be provided for yet another and differenly sized can. A larger diameter recess receives the larger diameter rim of a beer can while the smaller recess receives the smaller diameter rim of a soda can. In order for the rims of each of the cans to be retained within their respective recesses, the wall of each of the recesses is inclined outwardly in a longitudinal direction as seen from the bottom opening of the adapter. In this manner, when any rim of a can comes in contact with any of their respective recesses, the rim encounters an obstructing diameter of the corresponding recess of the flexible base first but because of the flexibility of the material of the adapter, a further force exerted on either the can or the adapter, will somewhat enlarge the encountered diameter so that the rim of the can will pass into the respective recess until the top edge of the rim encounters a lateral ceiling in the recess and will snugly seat there against. This snug and secure seating acts as a seal so that no liquid within the can will leak past the rim of the can to the exterior. However, a small O-ring could be placed at the ceiling of each of the recesses to assure a leak-proof performance between the can and the adapter.

It is now clear that an important object of this invention is to provide an adapter to be releasably placed on any sized beverage can that protects consumers from encountering germs or any other contamination that may exist on the lids of aluminum beverage cans.

DETAILED DESCRIPTION OF THE DRAWINGS

Figure 1:
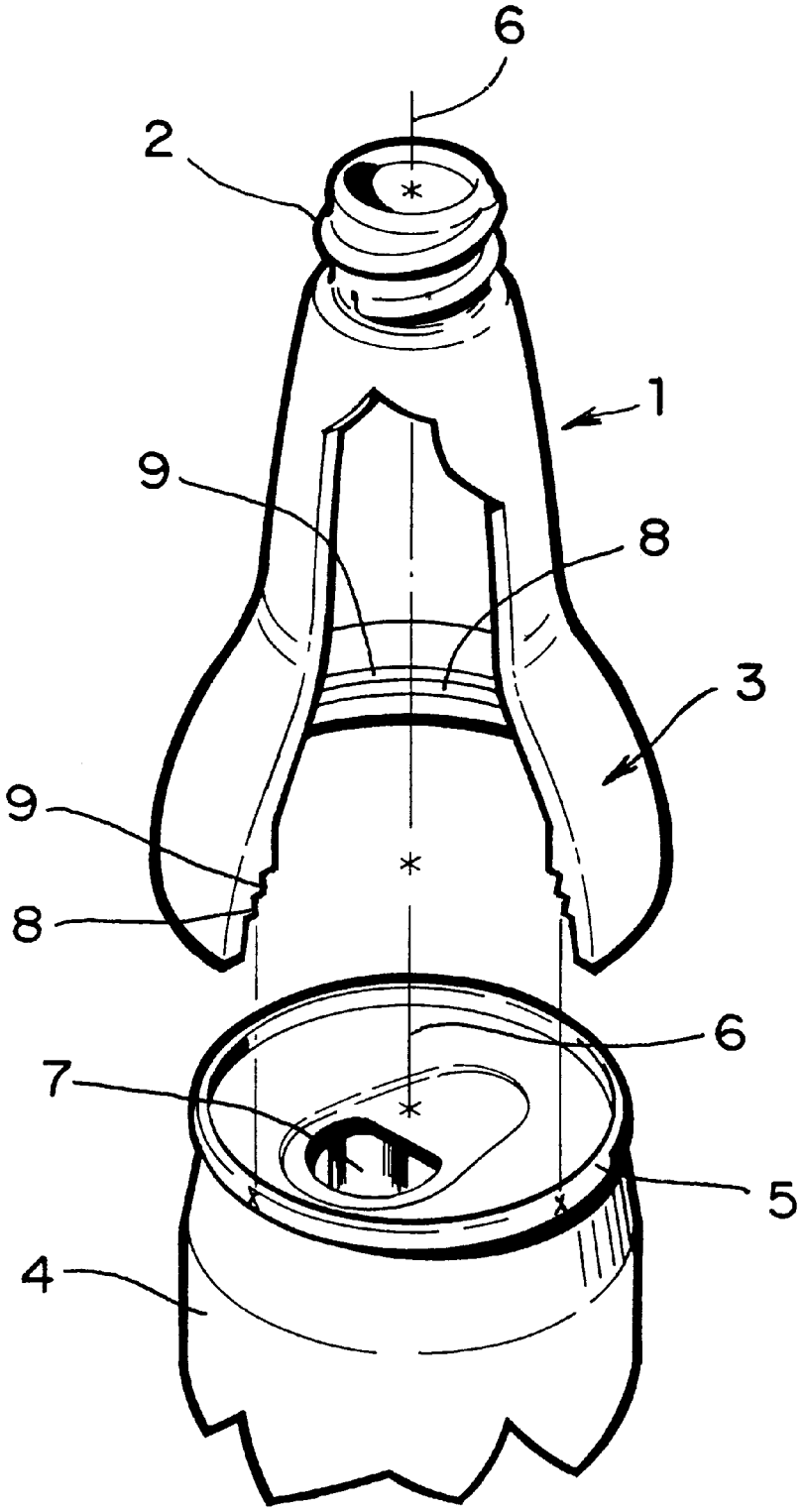
FIG. 1 is a perspective and an exploded view of the can and adapter combination

The reference character 1 indicates the overall adapter in the shape of a bottle neck. The bottle neck has a screw thread 2 at the top to receive a closure cap (not shown) thereon. The adapter 1 has a flared skirt 3 at the bottom thereof to simulate the shape of a bottle. Once the adapter is intimately and separably engaged with the top of can 4, the skirt 3 will hug the outer outline of the can 4. The can 4 itself has a beaded rim 5. the rim itself has a rounded edge. The numeral 6 indicates an axial line through both the can and the adapter. The numeral 7 is a pour opening in the top of the can 4. As mentioned above, the adapter is designed to accommodate at least two differently sized cans. Therefore, numerals 8 and 9 represent two differently sized recesses that are concentric with each other. The reference 8 is intended to show a recess for a larger can, such as a beer can, while the reference numeral 9 is intended to show a recess for a smaller beverage can, such as a soda can.

Figure 2:
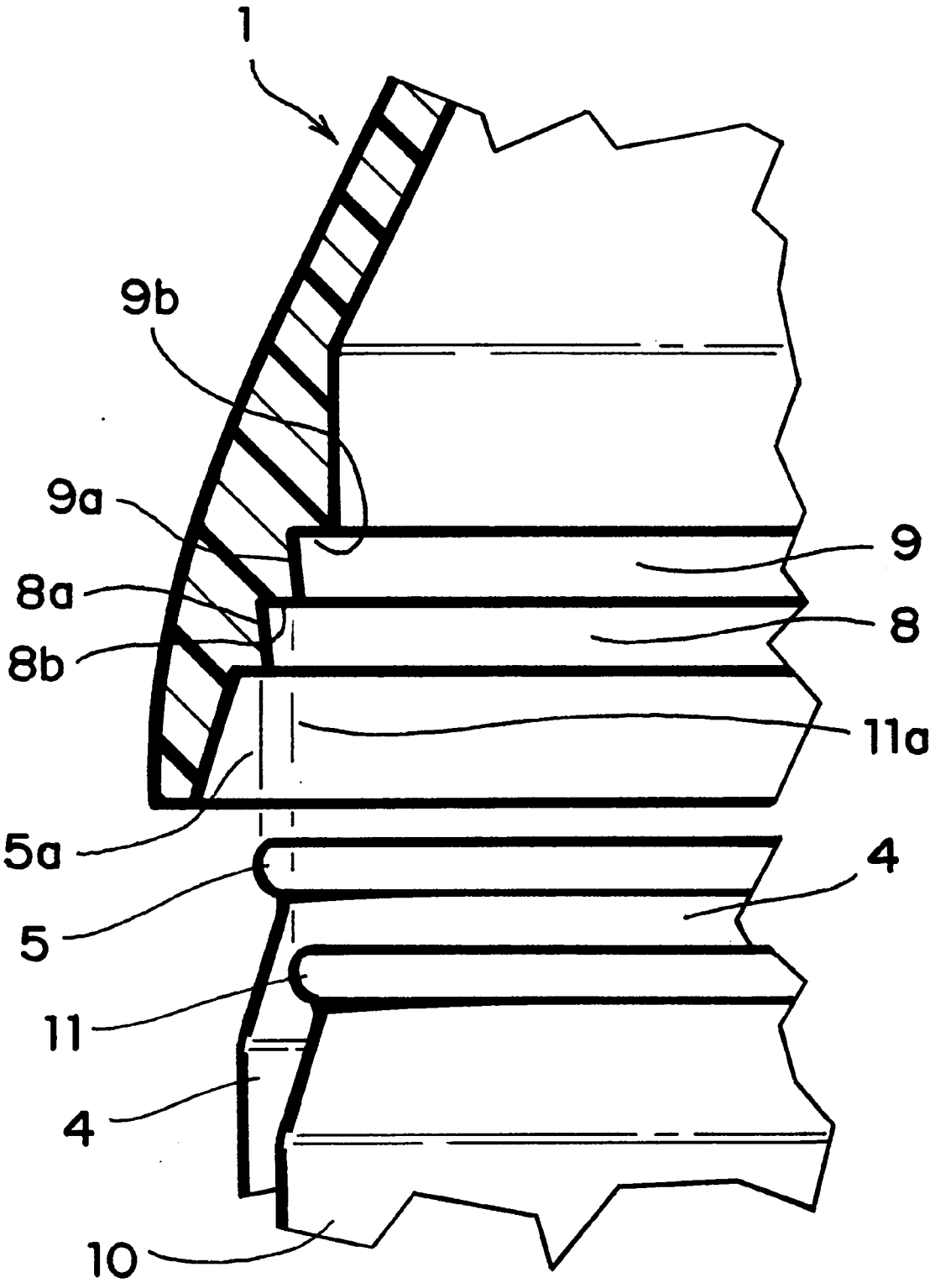
FIG. 2 is a detailed view of the differently sized recesses to receive differently sized beverage cans.

Turning now to FIG. 2, where like reference characters are applied to the same elements as in FIG. 1. There are shown the details of the concentric recesses 8 and 9. The larger recess 8 is designed to receive the larger beer can having a larger diameter rim 5. The recess 8 has a wall 8*a* that is inclined outwardly relative to the axial line 6 as seen from the bottom of the adapter 1 and ends in a lateral ceiling 8*b* which is normal to the axial line through the adapter and the can. This inclination includes the angle of about 6°.

The recess 9 has the same configuration as that of recess 8 which will accommodate smaller cans having smaller diameter rims such as a soda can. To this end, 9*a* is the wall inclined outwardly relative to the axial line 6 which has the same angular inclination of about 6° relative to the axial line 6. The recess 9 will accommodate the smaller can 10 with its smaller rim 11 and it also includes the lateral ceiling 9*b*. The reference numeral 11*a* indicates a reference line as to how the bead 11 of can 10 lines up with the recess 9 destined for the smaller can 10.

Even though only two recesses have been described and shown, more recesses could be placed into the adapter to accommodate smaller cans yet.

Figure 3:
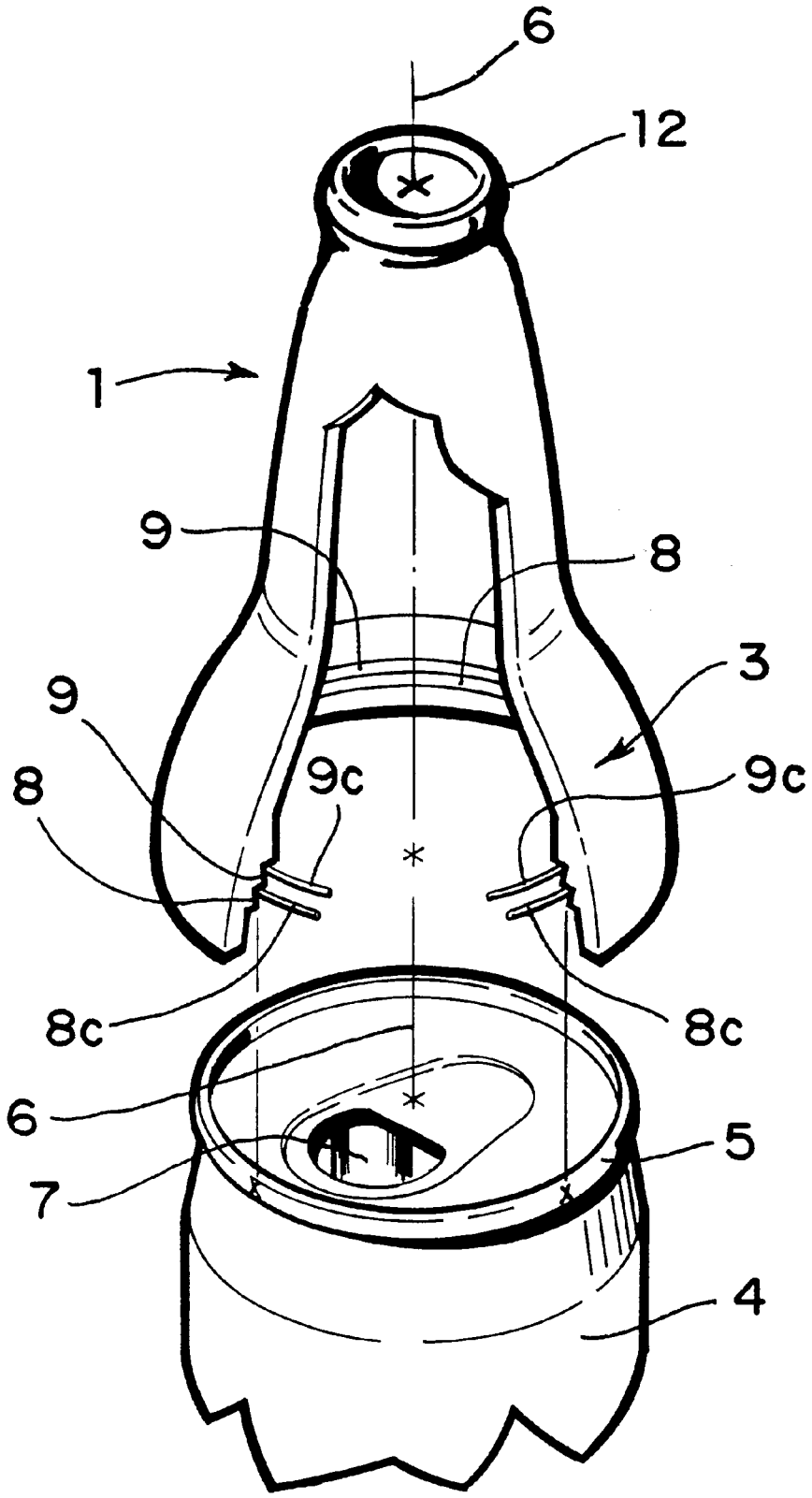
FIG. 3 is the same view as FIG. 1 but showing modifications of FIG. 1.

Turning now to FIG. 3, having the same reference characters as in FIG. 1. As a matter of fact FIG. 3 is the same as FIG. 1 except that O-rings 8*c* and 9*c* have been added. The use of O-rings is well known and the purpose of using them in this embodiment is to ensure a complete sealing of the liquid inside the can between the rim of the can and the adapter attached thereto just in case that there are any irregularities or distortions at the rims of the cans. Experience and testing has shown that all cans, whether large or small, will have a complete sealing fit in both recesses 8 or 9 because of the inclined wall 8*a* or 9*a* and the pressure created there. However, if there are any distortions in any of the rims 5 or 11, an O-ring placed at the ceilings 8*b* or 9*b* or both will ensure a sealing of the liquid between the can and the adapter.

Tests have also shown that the rounded edge of the rim of the can is instrumental in aiding the rim to enter either one or the other of the recesses 8 or 9. The rounded edge of the rim acts as a camming surface when the can is forced into the adapter. Also the top of the bottle 1 has been changed to that of a snap ring 12 which will accommodate a snap cover (not shown) instead of screw threads 2 to accommodate a screw cap (not shown).

It will thus be seen that the objects of the invention as set forth above, and those made apparent from the foregoing description, are efficiently attained and since certain changes may be made in the above disclosed device without departing from the scope of the invention, it is intended that all matters contained in the foregoing description or shown in the accompanying drawings shall be interpreted as illustrative and not in a limiting sense.

What is claimed is:

1. An adapter for attachment to a beverage can, comprising:

an adapter main body;

a tapered neck integral with said main body;

a base integral with said main body;

said neck, main body and base being of a generally tubular configuration and having a predetermined configuration and dimension of a spout region of a bottle;

means for detachably securing said base to differently sized rims of differently sized beverage cans, said means for detachably securing includes at least two recesses within said base, concentric to each other but spaced apart from each other in a longitudinal direction of said adapter, said recesses having different diameters corresponding to different diameter rims of differently sized cans; and each of the recesses having an inclined wall which is inclined outwardly relative to an axial line through said adapter to thereby form a lateral ceiling which is normal to an axial line through said adapter and said can against which a top of the rim of the can will seat.

2. The adapter of claim 1 including an o-ring placed in each of said recesses against the ceiling therein.

3. The adapter of claim 1 further including a screw thread placed at the top of the adapter.

4. The adapter of claim 1 further including an arrangement for a snap top closure.

5. An adapter for attachment to a beverage can, comprising:

an adapter main body;

a tapered neck integral with said main body;

a base integral with said main body;

said neck, main body and base being of a generally tubular configuration and having a predetermined configuration and dimension of a spout region of a bottle;

means for detachably securing said base to differently sized rims of differently sized beverage cans, said means for detachably securing includes at least two recesses within said base, concentric to each other but spaced apart from each other in a longitudinal direction of said adapter, said recesses having different diameters corresponding to different diameter rims of differently sized cans;

each of the recesses having an inclined wall which is inclined outwardly relative to an axial line through said adapter to thereby form a lateral ceiling which is normal to an axial line through said adapter and said can against which a top of the rim of the can will seat; and the recesses further including an o-ring placed in each of said recesses and against the ceiling therein.

6. The adapter of claim 5 further including a screw thread placed at the top of the adapter.

7. The adapter of claim 5 further including an arrangement for a snap top enclosure.

* * * * *